US008706508B2

(12) United States Patent
Suzuki et al.

(10) Patent No.: US 8,706,508 B2
(45) Date of Patent: Apr. 22, 2014

(54) AUDIO DECODING APPARATUS AND AUDIO DECODING METHOD PERFORMING WEIGHTED ADDITION ON SIGNALS

(75) Inventors: Masanao Suzuki, Kawasaki (JP); Miyuki Shirakawa, Fukuoka (JP); Yoshiteru Tsuchinaga, Fukuoka (JP)

(73) Assignee: Fujitsu Limited, Kawasaki (JP)

( * ) Notice: Subject to any disclaimer, the term of this patent is extended or adjusted under 35 U.S.C. 154(b) by 1085 days.

(21) Appl. No.: 12/659,306

(22) Filed: Mar. 3, 2010

(65) Prior Publication Data

US 2010/0228552 A1 Sep. 9, 2010

(30) Foreign Application Priority Data

Mar. 5, 2009 (JP) ..... 2009-51938

(51) Int. Cl.
*G10L 19/00* (2013.01)
*G10L 21/00* (2013.01)

(52) U.S. Cl.
USPC ..... 704/500; 704/501; 704/503

(58) Field of Classification Search
USPC ..... 704/500–504; 381/20–22
See application file for complete search history.

(56) References Cited

U.S. PATENT DOCUMENTS

| | | | | |
|---|---|---|---|---|
| 5,388,181 | A * | 2/1995 | Anderson et al. | 704/200.1 |
| 5,867,819 | A * | 2/1999 | Fukuchi et al. | 704/500 |
| 6,122,619 | A * | 9/2000 | Kolluru et al. | 704/500 |
| 6,931,291 | B1 * | 8/2005 | Alvarez-Tinoco et al. | 700/94 |
| 7,508,947 | B2 * | 3/2009 | Smithers | 381/21 |
| 8,155,971 | B2 * | 4/2012 | Hellmuth et al. | 704/501 |

FOREIGN PATENT DOCUMENTS

| | | |
|---|---|---|
| JP | 9-252254 | 9/1997 |
| JP | 2000-29498 | 1/2000 |
| JP | 2007-531913 | 11/2007 |
| WO | 2005/098821 A2 | 10/2005 |

* cited by examiner

*Primary Examiner* — Shaun Roberts
(74) *Attorney, Agent, or Firm* — Staas & Halsey LLP

(57) ABSTRACT

An audio decoding apparatus and method are provided. The audio decoding apparatus includes a spectrum converting part configured to divide the first frequency spectrum in each channel of the first audio signal in a time direction or in a frequency direction to calculate a first signal sequence having the same time resolution and the same frequency resolution in all the channels of the first audio signal, a down-mixing part configured to perform weighted addition on the signals at the same time and within the same frequency band included in the first signal sequence in all the channels to calculate a second signal sequence having channels of a second number different from the first number of channels.

11 Claims, 4 Drawing Sheets

AUDIO DECODING APPARATUS AND AUDIO DECODING METHOD PERFORMING WEIGHTED ADDITION ON SIGNALS

CROSS-REFERENCE TO RELATED APPLICATION(S)

This application is related to and claims the priority to Japanese Patent Application No. 2009-51938 filed on Mar. 5, 2009, and incorporated herein by reference.

BACKGROUND

1. Field

The embodiments discussed herein are directed to an audio decoding apparatus and an audio decoding method that include audio signals having channels of a number different from the number of channels of original audio signals.

2. Description of the Related Art

In recent years, digitalization of broadcasting including television broadcasting and radio broadcasting increased. For example, digital broadcast services including terrestrial digital television broadcasting, broadcasting satellite/communication satellite (BS/CS) digital broadcasting, and terrestrial digital audio broadcasting are provided in Japan. Such digital broadcasting adopts, for example, Moving Picture Experts Group phase 2 Advanced Audio Coding (MPEG-2 AAC) scheme capable of supporting multiple channels as a method of encoding audio signals. Accordingly, the digital broadcasting delivers many pieces of content including 5.1-channel audio outputs having a presence more excellent than that of stereos in related art. The 5.1-channel is hereinafter denoted by 5.1-ch. Similarly, a 3.1-channel and a 7.1-channel are hereinafter denoted by 3.1-ch and 7.1-ch, respectively.

However, audio decoding apparatuses that receive digital broadcasts to reproduce audio signals include many apparatuses that do not support decoding and reproduction of 5.1-ch audio signals. Consequently, down-mixing techniques are required to include audio signals, such as stereo audio signals, having channels of a number that is smaller than the number of channels of original multi-channel audio signals from the multi-channel audio signals, such as 5.1-channel audio signals.

Such down-mixing techniques include a technique to perform a down-mixing process on frequency-domain audio signals and convert the frequency-domain audio signals subjected to the down-mixing process into time-domain audio signals.

For example, refer to Japanese Laid-open Patent Publication No. 1997-252254, Japanese Laid-open Patent Publication No. 2000-29498, and Japanese Laid-open Patent Publication No. 2007-531913.

In contrast, in the MPEG-2 AAC scheme mentioned above, Modified Discrete Cosine Transform (MDCT) is used to encode audio signals and time-domain audio signals are converted into frequency spectra. Audio encoding apparatuses adopting the MPEG-2 AAC scheme vary the length of a window, which is the processing unit in the MDCT, depending on the characteristics of the audio signals when MDCT processing is performed on the audio signals. For example, a typical audio encoding apparatus performs the MDCT processing on audio signals including a stationary sound by using a window including 2,048 sample points of the audio signal. In contrast, the audio encoding apparatus performs the MDCT processing on audio signals including a sound, such as an attack sound, which varies in a short time by using a window including 256 sample points of the audio signal.

Accordingly, different lengths of windows may be used in different channels in the audio signals encoded by the audio encoding apparatus.

In such a case, a typical audio decoding apparatus adopting the down-mixing technique in the related art described above cannot directly perform the down-mixing process on frequency-domain audio signals because the frequency-domain audio signals in different channels are calculated by using different time lengths. In addition, the audio decoding apparatus in the related art performs Inverse Modified Discrete Cosine Transform on the frequency-domain audio signals in each channel before the down-mixing process is performed to convert the frequency-domain audio signals into time-domain audio signals. The Inverse Modified Discrete Cosine Transform is hereinafter denoted by IMDCT. Furthermore, in the audio decoding apparatus in the related art, it may be necessary to perform the MDCT processing again on the time-domain audio signals in all the channels by using a common window. As described above, it may be necessary to perform the MDCT processing and the IMDCT processing on the audio signals in the respective channels in order to perform the down-mixing process in the audio decoding apparatus in the related art, so that an enormous amount of calculation is required.

SUMMARY

It is an aspect of the embodiments discussed herein to provide an audio decoding apparatus and method.

The above aspects can be attained by an audio decoding apparatus including a signal acquiring part configured to receive a first audio signal that has a first number of channels and that is encoded, a dequantizing part configured to decode and dequantize the encoded first audio signal in each channel to calculate a first frequency spectrum, a spectrum converting part configured to divide the first frequency spectrum in each channel of the first audio signal in a time direction or in a frequency direction to calculate a first signal sequence having the same time resolution and the same frequency resolution in all the channels of the first audio signal; a down-mixing part configured to perform weighted addition on the signals at the same time and within the same frequency band included in the first signal sequence in all the channels to include a second signal sequence having channels of a second number different from the first number of channels, a spectrum inverting part configured to obtain one frequency spectrum value of the same frequency band from the signals within the frequency band included in each of the second signal sequences of a first predetermined number, which are continuous in the time direction, in each channel of the second signal sequence or obtain one frequency spectrum value from the signals within frequency bands of a second predetermined number, which are continuous in the frequency direction, in the second signal sequence to convert the second signal sequence into a second frequency spectrum having the second number of channels; and an audio recomposing part configured to convert the second frequency spectrum into a second audio signal in a time domain.

These together with other aspects and advantages which will be subsequently apparent, reside in the details of construction and operation as more fully hereinafter described and claimed, reference being had to the accompanying drawings forming a part hereof, wherein like numerals refer to like parts throughout.

DETAILED DESCRIPTION OF THE EMBODIMENTS

An audio decoding apparatus according to an exemplary embodiment performs the down-mixing process on a 5.1-ch audio signal to include a two-channel stereo audio signal. Specifically, the audio decoding apparatus performs the down-mixing process after dividing MDCT coefficients in each channel included in the 5.1-ch audio signal so that the time resolution coincides with the frequency resolution. The audio decoding apparatus converts the signals resulting from the down-mixing process into MDCT coefficients having a certain time resolution and a certain frequency resolution and, then, converts the resulting MDCT coefficients into time-domain audio signals. In the above manner, the audio decoding apparatus performs the down-mixing process even on the 5.1-ch audio signal encoded by using windows of different lengths in different channels without converting the 5.1-ch audio signal into a time-domain audio signal.

Figure 1:
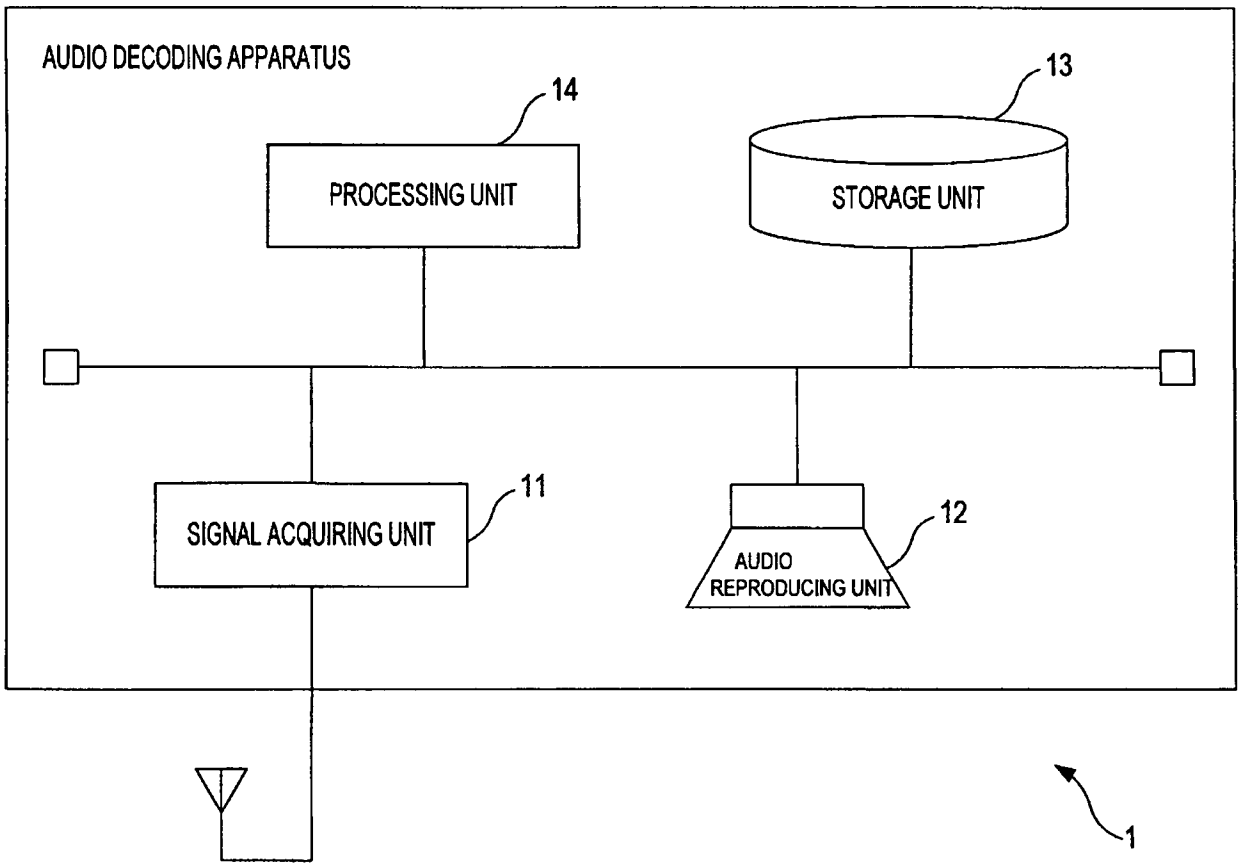
FIG. 1 illustrates an audio decoding apparatus according to an exemplary embodiment.

FIG. 1 illustrates an audio decoding apparatus 1 according to an exemplary embodiment. Referring to FIG. 1, the audio decoding apparatus 1 includes a signal acquiring unit 11, an audio reproducing unit 12, a storage unit 13, and a processing unit 14.

The signal acquiring unit 11 receives a 5.1-ch audio signal. The signal acquiring unit 11 includes, for example, an antenna with which an airwave is received and an amplifier circuit that amplifies the signal received with the antenna. Alternatively, the signal acquiring unit 11 may include a communication interface through which the audio decoding apparatus 1 may be connected to a communication network (not illustrated) and a control circuit for the communication interface. For example, the signal acquiring unit 11 may include a communication interface through which the audio decoding apparatus 1 may be connected to a communication network conforming to a communication standard, such as Ethernet (registered trademark), or Integrated Services Digital Network (ISDN) and a control circuit for the communication interface.

The signal acquiring unit 11 may be connected to the processing unit 14 to supply the received audio signal to the processing unit 14.

The audio reproducing unit 12 converts a stereo audio signal included by the processing unit 14 into an aerial vibration corresponding to the strength of the stereo audio signal to output a stereophonic sound. The audio reproducing unit 12 includes a left-channel speaker and a right-channel speaker.

The storage unit 13 includes, for example, at least one of a semiconductor memory, a magnetic disk device, and an optical disk device. The storage unit 13 stores computer programs and a variety of data used in the audio decoding apparatus 1. The storage unit 13 may store audio signals received through the signal acquiring unit 11 or audio signals included by the processing unit 14. In addition, the storage unit 13 also functions as a buffer memory that temporarily stores intermediate signals used by the processing unit 14 for the down-mixing process.

The processing unit 14 includes one or more processors and their peripheral circuits. The processing unit 14 performs the down-mixing process on the frequency spectrum of the 5.1-ch audio signal received through the signal acquiring unit 11 without converting the 5.1-ch audio signal into a time-domain audio signal. The processing unit 14 recomposes a time-domain audio signal from the frequency spectrum resulting from the down-mixing process.

The 5.1-ch audio signal received by the audio decoding apparatus 1 will now be briefly described. The audio signal in each channel is subjected to the MDCT processing in an audio encoding apparatus (not illustrated) to be converted into a set of MDCT coefficients representing a frequency spectrum. The MDCT processing is performed according to Equation (1):

$$y(k) = \sum_{t=0}^{N-1} w(t)x(t)\cos[\pi(2t+1+n)(2k+1)/2N] \tag{1}$$

where "x(t)" denotes the signal value of a sample point t (t=0, 1, 2, . . . , or N−1) of an audio signal that is received and "w(t)" denotes a window function. For example, a Kaiser-Bessel derived window is used as the window function. In Equation (1), "y(k)" denotes an MDCT coefficient, "N" denotes the total number of samples included in the window, and "n" denotes a phase term (n=N/2).

The set of MDCT coefficients calculated according to Equation (1) includes the MDCT coefficients of a number half of the total number N of the received samples.

The audio encoding apparatus sequentially performs the MDCT processing on the audio signals that are received while shifting the position of the window along the time axis so that a first half of the length of the window is overlapped with a last half of the length of a window used in the MDCT processing at the previous time.

The set of MDCT coefficients corresponding to the audio signal in each channel is quantized and, then, encoded by using entropy coding, such as a Huffman code. The quantization and the encoding are repeated multiple times. The set of MDCT coefficients quantized and encoded in each channel is mapped on one data stream and the set of MDCT coefficients mapped on one data stream is delivered.

The audio encoding apparatus determines the length of the window, which is the processing unit in the MDCT, depending on the characteristics of the audio signal in each channel in the MDCT processing on the audio signal in each channel. For example, the audio encoding apparatus conforming to the MPEG-2 AAC scheme selectively uses a window length of 2,048 samples or a window length of 256 samples depending on the characteristics of an input signal. The audio encoding apparatus may select the window length of 2,048 samples for a stationary sound and may select the window length of 256 samples for, for example, an attack sound. Accordingly, the MDCT coefficients in different channels may have different time resolutions.

In addition, the number of MDCT coefficients included in one set of MDCT coefficients is varied depending on the length of the window used in the MDCT processing. For example, the set of MDCT coefficients calculated by using the window including 256 samples includes 128 MDCT coefficients allocated to the respective frequency bands resulting from division of a frequency range from 0 Hz to 24 kHz into 128 equal segments. In contrast, the set of MDCT coefficients calculated by using the window including 2,048 samples includes 1,024 MDCT coefficients allocated to the respective frequency bands resulting from division of a frequency range from 0 Hz to 24 kHz into 1,024 equal segments. Accordingly, the MDCT coefficients in different channels may have different frequency resolutions.

As described above, in the 5.1-ch audio signal received by the audio decoding apparatus 1, the MDCT correlations in different channels may have different time resolutions and different frequency resolutions. For this reason, it may be necessary for the processing unit 14 in the audio decoding apparatus 1 to cause the MDCT coefficients in each channel to have the same time resolution and the same frequency resolution in order to perform the down-mixing process on the 5.1-ch audio signal that is received.

Figure 2:
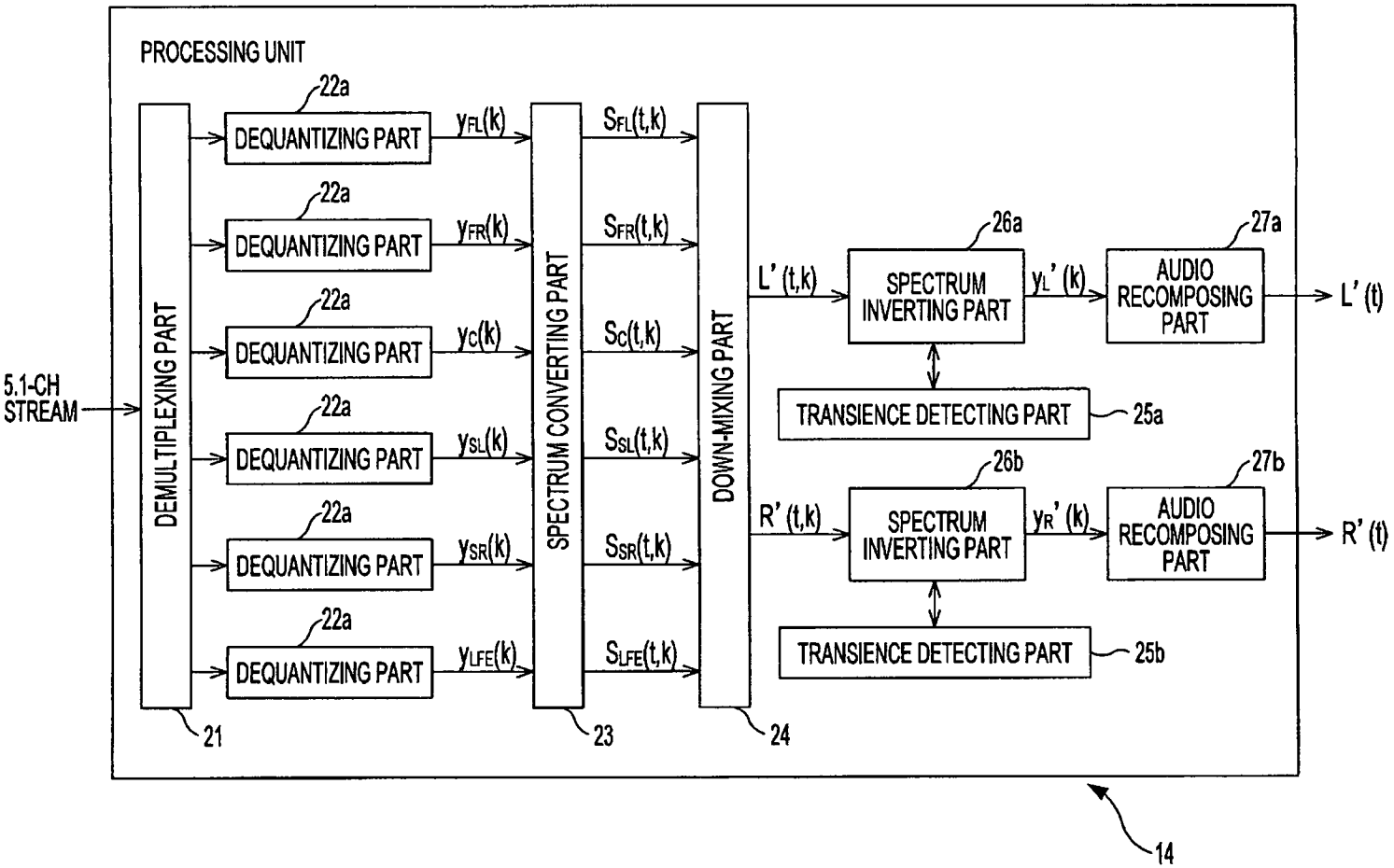
FIG. 2 illustrates an exemplary processing unit and an exemplary down-mixing process.

FIG. 2 illustrates an exemplary the processing unit 14, illustrating functions that are realized to perform the down-mixing process. Referring to FIG. 2, the processing unit 14 includes a demultiplexing part 21, dequantizing parts 22*a* to 22*f*, a spectrum converting part 23, a down-mixing part 24, transience detecting parts 25*a* and 25*b*, spectrum inverting parts 26*a* and 26*b*, and audio recomposing parts 27*a* and 27*b*. The above components in the processing unit 14 are functional modules installed by computer programs that are executed in the processors in the processing unit 14. Alternatively, the above components in the processing unit 14 may be installed in the audio decoding apparatus 1 as firmware or may be installed in the audio decoding apparatus 1 as separate arithmetic circuits.

The demultiplexing part 21 acquires a set of MDCT coefficients quantized and encoded in each channel from an audio signal received as one data stream. A 5.1-ch audio signal includes the following channels:

- Left front channel supporting sounds output from locations in front of and to the left side of a listener
- Right front channel supporting sounds output from locations in front of and to the right side of the listener
- Center channel supporting sounds output from locations in front of the listener
- Left rear channel supporting sounds output from locations behind and to the left side of the listener
- Right rear channel supporting sounds output from locations behind and to the right side of the listener
- Low-frequency emphasis channel supporting low-frequency sounds.

The demultiplexing part 21 supplies the set of MDCT coefficients quantized and encoded in each channel to the dequantizing parts 22*a* to 22*f* corresponding to the respective channels.

Since the demultiplexing part 21 may be any of various demultiplexers used in audio decoding apparatuses, a detailed description of the configuration of the demultiplexing part 21 is omitted herein.

The dequantizing parts 22*a* to 22*f* decode and dequantize the audio signals in the corresponding channels subjected to the quantization and encoding to calculate the sets of MDCT coefficients. Specifically, the dequantizing part 22*a* calculates MDCT coefficients yFL(k) in the left front channel. The dequantizing part 22*b* calculates MDCT coefficients yFR(k) in the right front channel. The dequantizing part 22*c* calculates MDCT coefficients yC(k) in the center channel. The dequantizing part 22*d* calculates MDCT coefficients ySL(k) in the left rear channel. The dequantizing part 22*e* calculates MDCT coefficients ySR(k) in the right rear channel. The dequantizing part 22*f* calculates MDCT coefficients yLFE(k) in the low-frequency emphasis channel.

For example, each of the dequantizing parts 22*a* to 22*f* performs a decoding process corresponding to the encoding process applied to the received audio signal to obtain a quantized value and multiplies the quantized value by a certain value. Each of the dequantizing parts 22*a* to 22*f* repeats the decoding process and the dequantization process multiple times to obtain the set of MDCT coefficients.

The dequantizing parts 22*a* to 22*f* supply the obtained sets of MDCT coefficients in the corresponding channels to the spectrum converting part 23.

The spectrum converting part 23 divides the MDCT coefficients in each channel in the frequency-axis direction or in the time-axis direction so that the sets of MDCT coefficients in the respective channels have the same frequency resolution and the same time resolution. A signal that results from the division of the MDCT coefficients in the frequency-axis direction or in the time-axis direction and that has the same frequency resolution and the same time resolution in the respective channels is called a time-frequency signal in this specification for convenience.

As described above, the sets of MDCT coefficients in the respective channels may be obtained by using windows having different lengths. Accordingly, the spectrum converting part 23 calculates the time-frequency signals in each channel in units of frames. One frame corresponds to the period corresponding to a window including a larger number of samples of the audio signal. The window including a larger number of samples of the audio signal is called a LONG window while a window including samples of a number that is smaller than the number of samples included in the LONG window is called a SHORT window in this specification.

The spectrum converting part 23 divides the MDCT coefficients in each channel calculated by using the LONG window in the time-axis direction so that the time-frequency signals in each channel have a time resolution corresponding to the SHORT window. For example, it may be assumed that, in a frame, the MDCT coefficient yFL(k) in the left front channel is calculated by using the LONG window including 2,048 samples and the MDCT coefficients in the remaining channels are calculated by using the SHORT window including 256 samples. In this case, the unit time of the MDCT coefficients yFL(k) in the left front channel is eight times longer than that of the MDCT coefficients in the remaining channels. Accordingly, the spectrum converting part 23 divides the MDCT coefficient yFL(k) within each frequency band k=0, 1, . . . , or 1,023 in the left front channel of the frame into eight segments in the time-axis direction. The spectrum converting part 23 may set the value of a time-frequency signal SFL(t,k) at a time t=0, 1, . . . , or 7 resulting from the division to the same value as the original MDCT coefficient yFL(k). Alternatively, the spectrum converting part 23 may calculate the value of each time-frequency signal SFL(t,k) by linear interpolation between the MDCT coefficient of the corresponding frequency band in the frame and both or either of the MDCT coefficients of the corresponding frequency bands in the previous and subsequent frames. In order to calculate the value of the time-frequency signal by the linear interpolation, it is desirable that the processing unit 14 temporarily store the sets of MDCT coefficients in the respective channels in several frames, obtained by the dequantizing parts 22*a* to 22*f*, in the storage unit 13.

In addition, the spectrum converting part 23 divides each MDCT coefficient included the set of MDCT coefficients in each channel having a small number of signal values in the frequency direction in the frequency-axis direction so that the time-frequency signals in each channel have signal values of the same number as the set of MDCT coefficients having the largest number of signal values in the frequency direction.

For example, as in the above case, it may be assumed that, in a frame, the MDCT coefficient yFL(k) in the left front channel is calculated by using the LONG window including 2,048 samples and the MDCT coefficients in the remaining channels are calculated by using the SHORT window including 256 samples. In this case, the value of each MDCT coefficients yFL(k) in the left front channel corresponds to, for example, the frequency band resulting from division of the frequency range from 0 Hz to 24 kHz into 1,024 equal segments. In contrast, the value of each MDCT coefficients in the remaining channels corresponds to, for example, the frequency band resulting from division of the frequency range from 0 Hz to 24 kHz into 128 equal segments. In other words, the MDCT coefficients yFL(k) in the left front channel have a frequency resolution eight time higher than the frequency resolution of the MDCT coefficients in the remaining channels. Accordingly, the spectrum converting part 23 divides the MDCT coefficients of each frequency band included in the sets of MDCT coefficients in the channels other than the left front channel in the frame into eight segments in the frequency-axis direction. The spectrum converting part 23 may set the value of the time-frequency signal of each frequency band resulting from the division to the same value as the MDCT coefficient of the corresponding frequency band in the original MDCT coefficient. Alternatively, the spectrum converting part 23 may calculate the value of the time-frequency signal of each frequency band by the linear interpolation between the original MDCT coefficient corresponding to the frequency band and the MDCT coefficient of a frequency band adjacent to the frequency band of the original MDCT coefficient. The spectrum converting part 23 knows the length of the window used for each channel by referring to header information included in the data stream received by the processing unit 14 through the signal acquiring unit 11.

Figure 3A:
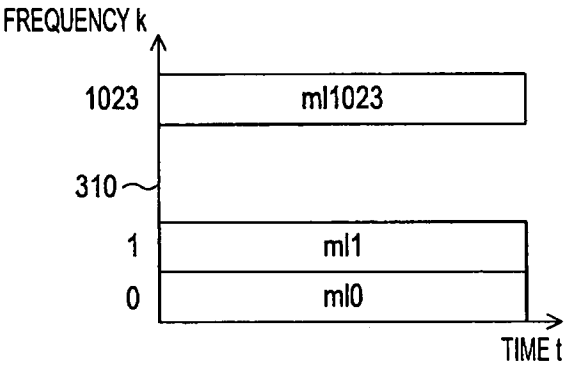
FIG. 3A illustrates MDCT coefficients calculated by using a LONG window.
Figure 3B:
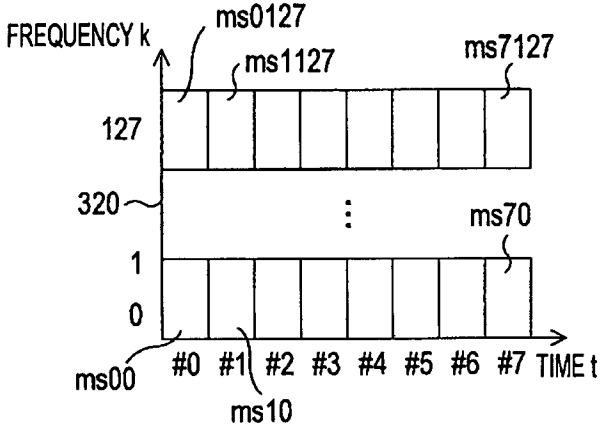
FIG. 3B illustrates MDCT coefficients calculated by using a SHORT window.
Figure 3C:
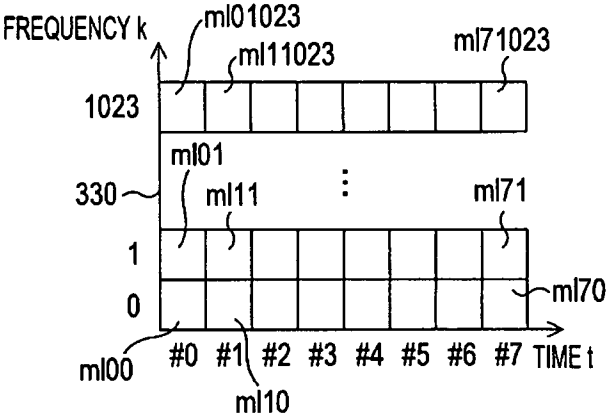
FIG. 3C illustrates time-frequency signals resulting from division of the MDCT coefficients illustrated in FIG. 3A.
Figure 3D:
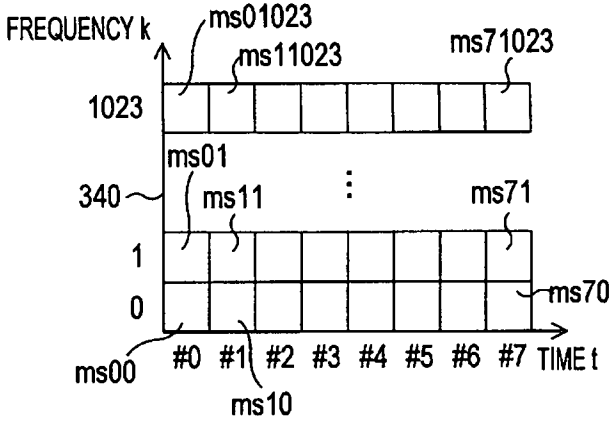
FIG. 3D illustrates time-frequency signals resulting from division of the MDCT coefficients illustrated in FIG. 3B.

FIG. 3A illustrates MDCT coefficients calculated by using the LONG window. FIG. 3B illustrates MDCT coefficients calculated by using the SHORT window. FIG. 3C illustrates a set 330 of time-frequency signals resulting from division of a set 310 of MDCT coefficients illustrated in FIG. 3A in the time-axis direction by the spectrum converting part 23. FIG. 3D illustrates a set 340 of time-frequency signals resulting from division of a set 320 of MDCT coefficients illustrated in FIG. 3B in the frequency-axis direction by the spectrum converting part 23. Referring to FIGS. 3A to 3D, the horizontal axis represents time and the vertical axis represents frequency. As illustrated in FIG. 3A, the set 310 of MDCT coefficients calculated by using the LONG window has coefficient values ml0, ml1, . . . , and ml1023 for the 1,024 respective frequency bands per one frame. In contrast, as illustrated in FIG. 3B, the set 320 of MDCT coefficients calculated by using the SHORT window has eight sets of coefficient values msn0, msn1, . . . , and msn127 for the 128 respective frequency bands per one frame (where n=0, 1, . . . , or 7). The spectrum converting part 23 divides the MDCT coefficient values ml0, ml1, . . . , and ml1023 for the respective frequency bands included in the set 310 of MDCT coefficients into eight segments in the time-axis direction to generate eight sets of time-frequency signals mln0, mln1, . . . , and mln1023, as illustrated in FIG. 3C. In addition, the spectrum converting part 23 divides the coefficient values msn0, msn1, . . . , and msn127 for the respective frequency bands included in the set 320 of MDCT coefficients into eight segments in the frequency-axis direction to generate eight sets of time-frequency signals msn0, msn1, . . . , and msn1023, as illustrated in FIG. 3D.

As apparent from FIGS. 3C and 3D, the time-frequency signals included in the set 330 of time-frequency signals and the set 340 of time-frequency signals in each channel produced by the spectrum converting part 23 have the same pseudo resolution both in the time-axis direction and the frequency-axis direction.

The spectrum converting part 23 supplies the time-frequency signals in each channel to the down-mixing part 24.

The down-mixing part 24 includes two time-frequency signals corresponding to the left and right stereo audio outputs from the time-frequency signals in each channel of the 5.1-ch audio signal, received from the spectrum converting part 23. As described above, the time-frequency signals in each channel have the same pseudo resolution both in the time-axis direction and the frequency-axis direction. Accordingly, the down-mixing part 24 can include desired time-frequency signals by performing certain weighted addition on the signals at the same time and within the same frequency band, among the time-frequency signals in each channel.

According to an exemplary embodiment, the down-mixing part 24 includes the two time-frequency signals corresponding to the left and right channels of the stereo audio output according to Equation (2) to (4):

$$L'(t,k)=G_0(S_{FL}(t,k)+G_1S_C(t,k)+G_2S_{SL}(t,k)) \quad (2)$$

$$R'(t,k)=G_0(S_{FR}(t,k)+G_1S_C(t,k)+G_2S_{SR}(t,k)) \quad (3)$$

$$S_{LFE}(t,k)\text{: not used} \quad (4)$$

where "SFL(t,k)" denotes the time-frequency signal in the left front channel, "SFR(t,k)" denotes the time-frequency signal in the right front channel, "SC(t,k)" denotes the time-frequency signal in the center channel, "SSL(t,k)" denotes the time-frequency signal in the left rear channel, "SSR(t,k)" denotes the time-frequency signal in the right rear channel, "SLFE(t,k)" denotes the time-frequency signal in the low-frequency emphasis channel, and "G0", "G1", and "G2" denote coefficients indicating gains.

For example, "G0" and "G1" are set to 0.707 corresponding to −3 dB. "G2" is set to 0.707 corresponding to −3 dB, to 0.5 corresponding to −6 dB, to 0.354 corresponding to −9 dB, or to zero.

In Equations (2) and (3), "L'(t,k)" and "R'(t,k)" denote time-frequency signals corresponding to the left and right channels, respectively, of the stereo audio output to be included.

The composition equations in Equations (2) to (4) are examples and the down-mixing part 24 may calculate the time-frequency signals L'(t,k) and R'(t,k) by using other composition equations. The "weighted addition" here includes no addition of the time-frequency signal in a specific channel such as the low-frequency emphasis channel in Equation (4), that is, addition of the time-frequency signal given by multiplication by zero as a coefficient.

The down-mixing part 24 supplies the resulting time-frequency signals L'(t,k) and R'(t,k) to the transience detecting parts 25*a* and 25*b* and the spectrum inverting parts 26*a* and 26*b*, respectively. In addition, the down-mixing part 24 temporarily stores the time-frequency signals L'(t,k) and R'(t,k) in the storage unit 13.

The transience detecting part 25*a* determines whether the time-frequency signal L'(t,k) has the transience. Similarly, the transience detecting part 25*b* determines whether the time-frequency signal R'(t,k) has the transience. The time-frequency signal has the transience if it corresponds to a sound, such as an attack sound, which suddenly varies. When the time-frequency signal has the transience, the time-frequency signal is converted into an MDCT coefficient having a higher time resolution to reproduce a sound having a small amount of noise for the listener. Consequently, the transience detecting parts 25*a* and 25*b* each determine whether the time-frequency signal has the transience as a criterion in determination of the time resolution of the MDCT coefficient to be converted from the time-frequency signal.

The transience detecting parts 25*a* and 25*b* determine that the time-frequency signal included in a target frame has the transience if the power of the time-frequency signal included in the target frame is not lower than a threshold value calculated from the powers of the time-frequency signals of several frames before the target frame. The frame corresponds to the length of the LONG window used in the encoding of the audio signal, as described above in the description of the spectrum converting part 23. A process performed by the transience detecting part 25*a* will now be specifically described. The transience detecting part 25*b* performs a process similar to that of the transience detecting part 25*a* except that the time-frequency signal R'(t,k) is the target of the determination. Accordingly, a description of the process performed by the transience detecting part 25*b* is omitted herein.

The transience detecting part 25*a* determines a threshold value ThPL(k) used in the determination of whether the time-frequency signal L'(t,k) has the transience according to Equation (5) based on the time-frequency signals of previous frames stored in the storage unit 13:

$$ThP_L(k) = \frac{1}{MN}\sum_{i=1}^{N}\sum_{t=0}^{M-1}[L'_{-i}(t,k)^2] + \Delta th \tag{5}$$

where "L'-i(t,k)" denotes the time-frequency signal at a time t in a frame i frames before the target frame and within a frequency band k, "N" denotes a natural number, which set to, for example, 10, "M" denotes the number of sets of time-frequency signals included in one frame, and "Δth" denotes a bias, which is added to the mean value of the power values of the respective frequency bands in the previous frames of a predetermined number in order to prevent the transience detecting part 25*a* from determining that the time-frequency signal has the transience when the power increases by a minute amount. For example, "Δth" may be set to a value equal to 5% or 10% of a maximum value of the power of the time-frequency signal L'(t,k).

The transience detecting part 25*a* may set the threshold value ThPL(k) to a value given by multiplying a first term of Equation (5) by a predetermined safety factor α. The first term of Equation (5) indicates the mean value of the power values of the respective frequency bands in previous frames of a predetermined number. In this case, the predetermined safety factor α is set to a value slightly larger than one, for example, to 1.1 or 1.2.

The power value of the time-frequency signal corresponding to a sound, such as an attack sound, having the transience instantaneously increases within all the frequency bands and the power value of the time-frequency signal tends to have a constant value within all the frequency bands. Accordingly, the transience detecting part 25*a* compares a power PowL(t,k) of the frequency band k of the time-frequency signal L'(t,k) at the time t in the target frame with the corresponding threshold value ThPL(k). The power PowL(t,k) is equal to the square of the time-frequency signal L'(t,k). If the powers PowL(t,k) within all the frequency bands are not lower than the corresponding threshold value ThPL(k) at a time t, the transience detecting part 25*a* determines that the time-frequency signal L'(t,k) included in the target frame has the transience. In contrast, if the power PowL(t,k) of any frequency band is lower than the corresponding threshold value ThPL(k) at all the times in the target frame, the transience detecting part 25*a* determines that the time-frequency signal L'(t,k) included in the target frame does not have the transience.

The transience detecting part 25*a* notifies the spectrum inverting part 26*a* of the result of the determination of whether the time-frequency signal L'(t,k) has the transience for every target frame. Similarly, the transience detecting part 25*b* notifies the spectrum inverting part 26*b* of the result of the determination of whether the time-frequency signal R'(t,k) has the transience for every target frame. Although the transience detecting parts use the power of the time-frequency signal to detect the transience of the frame in the above description, the transience detecting parts 25*a* and 25*b* may use information about the length of the window of the MDCT in each channel to be subjected to the down-mixing process as another easy detection method. Specifically, in this case, the transience detecting parts 25*a* and 25*b* refer to the header information included in the data stream received through the signal acquiring unit 11 to check the length of the window used for each channel in the target frame. If the SHORT window is used in any one channel, the transience detecting parts 25*a* and 25*b* determine that the time-frequency signal included in the target frame has the transience. In contrast, if the LONG window is used in all the channels, the transience detecting parts 25*a* and 25*b* determine that the time-frequency signal included in the target frame does not have the transience.

The spectrum inverting part 26*a* converts the time-frequency signal L'(t,k) into an MDCT coefficient y'L(k) in the left channel in accordance with the result of the determination of whether the time-frequency signal has the transience by the transience detecting part 25*a*. Similarly, the spectrum inverting part 26*b* converts the time-frequency signal R'(t,k) into an MDCT coefficient y'R(k) in the right channel in accordance with the result of the determination of whether the time-frequency signal has the transience by the transience detecting part 25*b*. A process performed by the spectrum inverting part 26*a* will now be specifically described. The spectrum inverting part 26*b* performs a process similar to that performed by the spectrum inverting part 26*a* except that the time-frequency signal R'(t,k) is to be processed. Accordingly, a detailed description of the process performed by the spectrum inverting part 26*b* is omitted herein.

If the time-frequency signal L'(t,k) has the transience, the spectrum inverting part 26*a* integrates the values of the time-frequency signals L'(t,k) within a predetermined number of continuous frequency bands to convert the time-frequency signal L'(t,k) into eight sets of MDCT coefficients y'L(k) that have a higher time frequency, that is, that can be subjected to the IMDCT processing by using the SHORT window. In contrast, if the time-frequency signal L'(t,k) does not have the transience, the spectrum inverting part 26*a* integrates the values of the time-frequency signals L'(t,k) within the same frequency band at the respective times in the same frame to obtain one MDCT coefficient for every frequency band. As a result, the time-frequency signal L'(t,k) is converted into one set of MDCT coefficients y'L(k) that have a lower time frequency, that is, that can be subjected to the IMDCT processing by using the LONG window.

For example, it may be assumed that the time-frequency signal L'(t,k) of the target frame has signal values for the respective 1,024 frequency bands and has signal values for the respective times each corresponding to the SHORT window including 256 samples of the time-domain audio signal. If the time-frequency signal L'(t,k) has the transience in the above case, the spectrum inverting part 26*a* calculates one MDCT coefficient for the frequency band resulting from the integration of eight continuous frequency bands of the time-frequency signal L'(t,k) into one at each time. The spectrum inverting part 26*a* may use the value calculated by simple average of the time-frequency signal values within the eight continuous frequency bands as the MDCT coefficient. Alternatively, the spectrum inverting part 26*a* may calculate the MDCT coefficient by weighted addition of the time-frequency signal values within the eight continuous frequency bands by using weighting factors in which the weight is reduced with the increasing distance from the central bandwidth of the eight continuous frequency bands. Alternatively, the spectrum inverting part 26*a* may use the median or mode of the time-frequency signal values within the eight continuous frequency bands as the MDCT coefficient. With any of the above methods, the spectrum inverting part 26*a* can convert the time-frequency signal L'(t,k) into eight sets of MDCT coefficients y'L(k) in which the set of MDCT coefficients at each time include 128 MDCT coefficients. The MDCT coefficients y'L(k) in each set can be subjected to the IMDCT processing by using the SHORT window.

In contrast, if the time-frequency signal L'(t,k) does not have the transience in the above case, the spectrum inverting part 26*a* calculates one MDCT coefficient from the values of the time-frequency signals L'(t,k) within the same frequency band at the respective times in the target frame. The spectrum inverting part 26*a* may use the value calculated by the simple average of the time-frequency signal values at all the times in the target frame for every frequency band as the MDCT coefficient for the frequency band. Alternatively, the spectrum inverting part 26*a* may calculate the MDCT coefficients for every frequency band by weighted addition of the time-frequency signal values at all the times within the frequency band by using weighting factors in which the weight is reduced with the increasing distance from the central time in the target frame. Alternatively, the spectrum inverting part 26*a* may use the median or mode of the time-frequency signal values at all the times in the target frame as the MDCT coefficient for every frequency band. With any of the above methods, the spectrum inverting part 26*a* can convert the time-frequency signal L'(t,k) of the target frame into one set of MDCT coefficients y'L(k) including 1,024 MDCT coefficients. The one set of MDCT coefficients y'L(k) can be subjected to the IMDCT processing by using the LONG window including 2,048 samples of the audio signal.

The spectrum inverting part 26*a* supplies the calculated MDCT coefficients y'L(k) to the audio recomposing part 27*a*. The spectrum inverting part 26*b* supplies the calculated MDCT coefficients y'R(k) to the audio recomposing part 27*b*.

The audio recomposing part 27*a* performs the IMDCT processing on the MDCT coefficients y'L(k) received from the spectrum inverting part 26*a* to obtain a left-channel audio signal L'(t) of the stereo audio output. Similarly, the recomposing part 27*b* performs the IMDCT processing on the MDCT coefficients y'R(k) received from the spectrum inverting part 26*b* to obtain a right-channel audio signal R'(t) of the stereo audio output. The IMDCT processing is performed according to Equation (6):

$$x(t) = \sum_{k=0}^{N/2-1} y(k)\cos[\pi(2t+1+n)(2k+1)/2N] \tag{6}$$

where "y(k)" denotes an MDCT coefficient, "x(t)" denotes the signal value at a sample point t (t=0,1, 2, . . . , or N−1) of the audio signal to be recomposed, "N" corresponds to the length of a window and indicates the total number of samples included in the window, and "n" denotes a phase term (n=N/2).

The time-domain signal calculated according to (6) includes sample signals of a number that is twice the total number of the received MDCT coefficients. Each of the audio recomposing parts 27*a* and 27*b* stores the obtained time-domain signal in the storage unit 13. Then, each of the audio recomposing parts 27*a* and 27*b* multiplies the stored signal by a window function having the same shape as the window function used in the calculation of the MDCT coefficients in each channel of the audio signal received by the audio decoding apparatus 1 to obtain the time-domain audio signal. However, in the calculation of the MDCT coefficients in each channel of the audio signal received by the audio decoding apparatus 1, the window at each time is set so as to be overlapped with the windows at the previous and subsequent times. Accordingly, each of the audio recomposing parts 27*a* and 27*b* adds up the parts that are overlapped with the time-domain signals calculated from the MDCT coefficients at the previous and subsequent times in the time-domain signal resulting from the multiplication of the window function to recompose the audio signal.

The audio recomposing parts 27*a* and 27*b* supply the recomposed audio signals to the audio reproducing unit 12.

Figure 4:
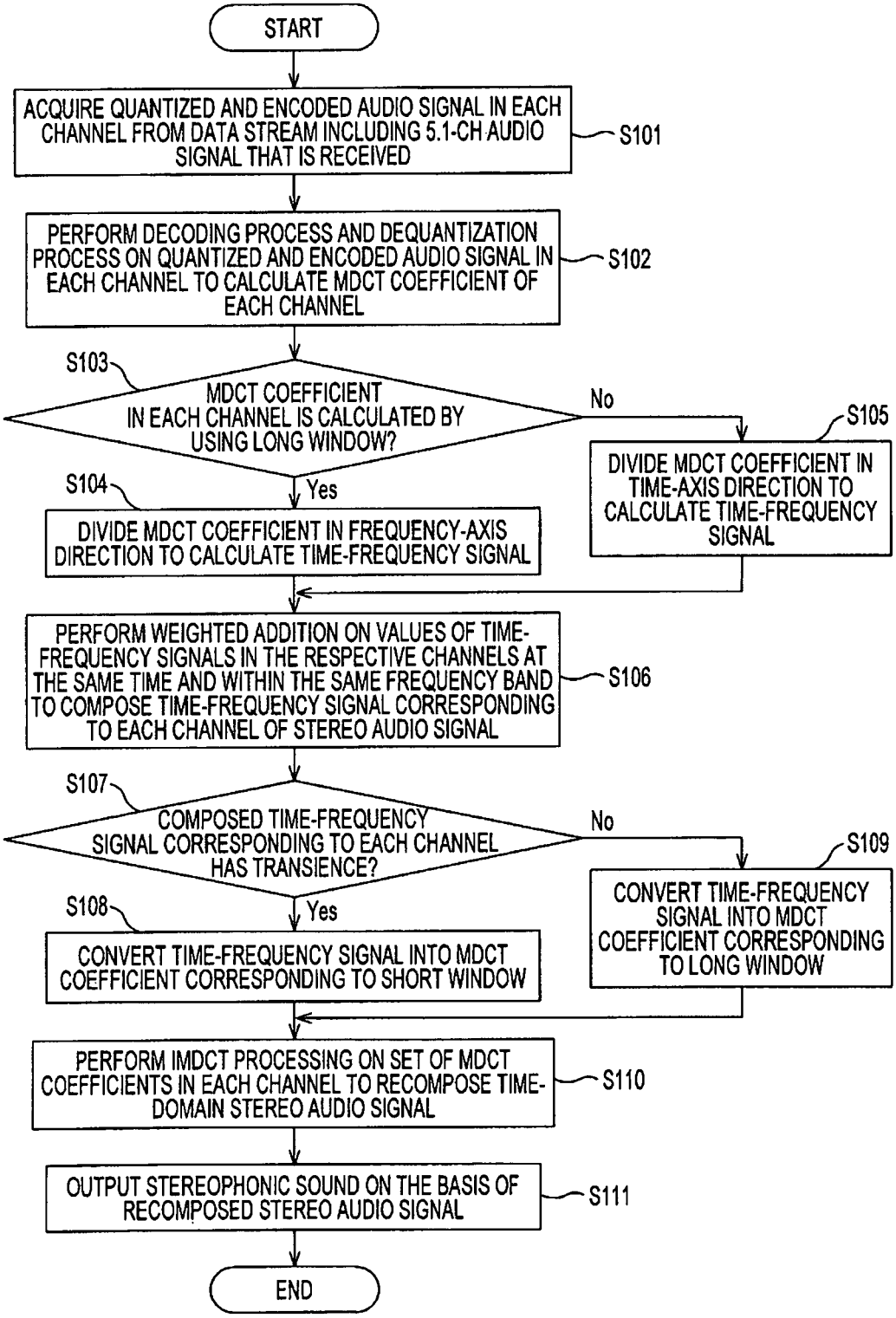
FIG. 4 illustrates a process of down mixing an audio signal, controlled by a computer program executed in a processing unit in an audio decoding apparatus according to an exemplary embodiment.

FIG. 4 illustrates an exemplary process of down mixing an audio signal, controlled by a computer program executed in the processing unit 14. The flowchart in FIG. 4 indicates the process for the audio signal corresponding to one frame. The audio decoding apparatus 1 repeats the down-mixing process in FIG. 4 for every frame while the audio decoding apparatus 1 continues to receive audio signals.

Referring to FIG. 4, upon reception of a data stream including a 5.1-ch audio signal by the audio decoding apparatus 1 with the signal acquiring unit 11, the processing unit 14 in the audio decoding apparatus 1 starts the down-mixing process. In Operation S101, the demultiplexing part 21 in the processing unit 14 acquires an audio signal in each channel, which is quantized and encoded, from the received data stream including the 5.1-ch audio signal. The demultiplexing part 21 supplies the audio signals in the respective channels, which are quantized and encoded, to the dequantizing parts 22*a* to 22*f* in the processing unit 14 corresponding to the respective channels. In Operation S102, each of the dequantizing parts 22*a* to 22*f* performs a decoding process and a dequantization process on the audio signal in the corresponding channel, which is quantized and encoded, to calculate the MDCT coefficient in the corresponding channel. The dequantizing parts 22*a* to 22*f* supply the calculated MDCT coefficients in the corresponding channels to the spectrum converting part 23 in the processing unit 14.

In Operation S103, the spectrum converting part 23 refers to the header information included in the received data stream to determine whether the MDCT coefficients in each channel are calculated by using the LONG window. If the MDCT coefficients in the target channel are calculated by using the LONG window (YES in Operation S103), in Operation S104, the spectrum converting part 23 divides the MDCT coefficient in the time-axis direction to calculate a time-frequency signal. If the MDCT coefficient in the target channel is calculated by using the SHORT window (NO in Operation S103), in Operation S105, the spectrum converting part 23 divides the MDCT coefficient in the frequency-axis direction to calculate a time-frequency signal. The spectrum converting part 23 supplies the time-frequency signals in the respective channels to the down-mixing part 24 in the processing unit 14 after completing Operation S104 or S105 for all the channels.

In Operation S106, the down-mixing part 24 performs the weighted addition on the values of the time-frequency signals in the respective channels at the same time and within the same frequency band to include the time-frequency signals corresponding to the respective channels of the stereo audio signal. For example, the down-mixing part 24 performs the weighted addition on the values of the time-frequency signals in the respective channels according to Equations (2) to (4) to include the time-frequency signals corresponding to the left and right stereo channels. The down-mixing part 24 supplies the time-frequency signals corresponding to the left and right stereo channels to the transience detecting parts 25*a* and 25*b* and the spectrum inverting parts 26*a* and 26*b*, respectively, in the processing unit 14.

In Operation S107, the transience detecting parts 25*a* and 25*b* determine whether the included time-frequency signals corresponding to the left and right stereo channels, respectively, have the transience. The transience detecting parts 25*a* and 25*b* notify the spectrum inverting parts 26*a* and 26*b*, respectively, of the result of the determination. If it is determined that the time-frequency signal received from the down-mixing part 24 has the transience (YES in Operation S107), in Operation S108, each of the spectrum inverting parts 26*a* and 26*b* converts the corresponding time-frequency signal into the MDCT coefficient corresponding to the SHORT window. Specifically, each of the spectrum inverting parts 26*a* and 26*b* calculates one MDCT coefficient as a statistical value of the time-frequency signals within frequency bands of a predetermined number so as to integrate the predetermined number of continuous frequency bands into one frequency band.

If it is determined that the time-frequency signal received from the down-mixing part 24 does not have the transience (NO in Operation S107), in Operation S109, each of the spectrum inverting parts 26*a* and 26*b* converts the corresponding time-frequency signal into the MDCT coefficient corresponding to the LONG window. Each of the spectrum inverting parts 26*a* and 26*b* calculates one MDCT coefficient as a statistical value of the time-frequency signals within the same frequency band in the target frame so as to integrate the sets of time-frequency signals at the respective times in the target frame into one set of MDCT coefficients.

After Operation S108 or Operation S109, the spectrum inverting parts 26*a* and 26*b* supply the sets of MDCT coefficients to the audio recomposing parts 27*a* and 27*b*, respectively, in the processing unit 14.

In Operation S110, each of the audio recomposing parts 27*a* and 27*b* performs the IMDCT processing on the received set of MDCT coefficients to recompose a time-domain stereo audio signal. The audio recomposing parts 27*a* and 27*b* supply the resulting stereo audio signals to the audio reproducing unit 12. In Operation S111, the audio reproducing unit 12 outputs a stereophonic sound based on the recomposed stereo audio signals. Then, the audio decoding apparatus 1 completes the down-mixing process on the audio signal corresponding to one frame.

The audio decoding apparatus according to an exemplary embodiment divides the MDCT coefficients in each channel of a 5.1-ch audio signal that is received in the time-axis direction or in the frequency-axis direction. The audio decoding apparatus obtains the time-frequency signals having the same time resolution and the same frequency resolution in all the channels. The audio decoding apparatus performs the weighted addition on the values of the time-frequency signals in each channel at the same time and within the same frequency band to include the time-frequency signals corresponding to the respective channels of the stereo audio signal. The audio decoding apparatus converts the time-frequency signals into the MDCT coefficients corresponding to the LONG window or the SHORT window based on the result of the determination of whether the time-frequency signal has the transience. Then, the audio decoding apparatus performs the IMDCT processing on the resulting MDCT coefficients to recompose the stereo audio signals. In the above manner, the audio decoding apparatus can perform the down-mixing process even on the multi-channel audio signal that is encoded by using the windows of different lengths in different channels without converting the multi-channel audio signal into the time-domain audio signal. Accordingly, since the number of times when the MDCT processing and the IMDCT processing are performed can be reduced in the audio decoding apparatus, it is possible to greatly reduce the amount of calculation required for the down-mixing process.

According to an exemplary embodiment, the original audio signal in each channel received by the audio decoding apparatus may be converted into the MDCT coefficient by using any of windows having three or more different lengths. In this case, the spectrum converting part divides the MDCT coefficients in each channel in the time-axis direction so that the MDCT coefficients in each channel have the time resolution coinciding with that of the MDCT coefficients calculated by using the window having the smallest length. In addition, the spectrum converting part divides the MDCT coefficients in each channel in the frequency-axis direction so that the MDCT coefficients in each channel have the frequency resolution coinciding with that of the MDCT coefficient calculated by using the window having the greatest length. There are cases in which the lengths of the windows used in the calculation of the MDCT coefficients are not integer multiples of the length of the shortest window. When the spectrum converting part divides the MDCT coefficients in each channel in the time-axis direction so that the time-frequency signals in each channel have the time resolution of the length corresponding to the greatest common divisor of the lengths of the windows. In addition, the spectrum converting part divides the MDCT coefficients in each channel in the frequency-axis direction so that the number of the time-frequency signals in each channel in the frequency direction corresponds to the least common multiple of the number of the MDCT coefficients in each channel in the frequency-axis direction.

For example, it may be assumed that the MDCT coefficients in the left front channel are calculated by using the window including 2,048 samples, the MDCT coefficients in the right front channel are calculated by using the window including 1,024 samples, and the MDCT coefficients in the remaining channels are calculated by using the window including 768 samples. In this case, the greatest common divisor of the lengths of the windows is equal to 256 in units of the number of samples. Accordingly, the spectrum converting part divides the MDCT coefficients in the left front channel into eight segments in the time-axis direction, divides the MDCT coefficients in the right front channel into four segments in the time-axis direction, and divides the MDCT coefficients in the remaining channels into three segments in the time-axis direction. Here, one set of MDCT coefficients includes 1,024 MDCT coefficients in the frequency-axis direction in the left front channel, one set of MDCT coefficients includes 512 MDCT coefficients in the frequency-axis direction in the right front channel, and one set of MDCT coefficients includes 384 MDCT coefficients in the frequency-axis direction in the remaining channels. In this case, the least common multiple of the numbers of the MDCT coefficients in each channel in the frequency-axis direction is equal to 3,072. Accordingly, the spectrum converting part divides the MDCT coefficients in the left front channel into three segments in the frequency-axis direction, divides the MDCT coefficients in the right front channel into six segments in the frequency-axis direction, and divides the MDCT coefficients in the remaining channels into eight segments in the frequency-axis direction.

It may be sufficient for the down-mixing part to perform the weighted addition on the time-frequency signals in each channel at the same time and within the same frequency band, as in the above embodiment, even when the audio signal in each channel is converted into the MDCT coefficients by using any of the windows having three or more different lengths.

However, it may be necessary for the spectrum inverting part to convert the included time-frequency signals into the MDCT coefficients corresponding to the window having any length among the three or more different lengths of the windows. Accordingly, the transience detecting part determines the level of transience of each frame of the time-frequency signal in order to determine the window of the length corresponding to the MDCT coefficient to which the time-frequency signal is to be converted. For example, if windows having three different lengths are used to calculate the MDCT coefficients, the transience detecting part determines whether the time-frequency signal has a minimum level of transience, which is to be converted into the MDCT coefficient corresponding to the longest window. For the determination, the transience detecting part compares the power of the time frequency of each frequency band with the threshold value calculated according to Equation (5) from the time-frequency signals included in the frames that were acquired before the target frame for every time included in the target frame. If the power of any frequency band is lower than the corresponding threshold value at all the times in the target frame, the transience detecting part determines that the time-frequency signal included in the target frame does not have the transience. In other words, the transience detecting part determines that the time-frequency signal included in the target frame has the minimum level of transience.

In contrast, if the powers of all the frequency bands are not lower than the threshold value at any time in the target frame, the transience detecting part determines whether the target frame has a maximum level of transience or an intermediate level of transience. If the powers of all the frequency bands are not lower than the threshold value at two or more continuous times in the target frame, the transience detecting part determines that the target frame has the intermediate level of transience. If the time when the powers of all the frequency bands are not lower than the threshold value does not continuously appear in the target frame, the transience detecting part determines that the target frame has the maximum level of transience.

The transience detecting part notifies the spectrum inverting part of the result of the determination of the transience level.

If the spectrum inverting part receives the notification indicating that the target frame has the minimum level of transience from the transience detecting part, the spectrum inverting part converts the time-frequency signal into the MDCT coefficient corresponding to the longest window. If the spectrum inverting part receives the notification indicating that the target frame has the intermediate level of transience from the transience detecting part, the spectrum inverting part converts the time-frequency signal into the MDCT coefficient corresponding to the second shortest window. If the spectrum inverting part receives the notification indicating that the target frame has the maximum level of transience from the transience detecting part, the spectrum inverting part converts the time-frequency signal into the MDCT coefficient corresponding to the shortest window.

Also if the MDCT coefficient is calculated by using any of the windows having three or more different lengths, the spectrum inverting part can convert the time-frequency signal into the MDCT coefficient corresponding to the window having an appropriate length based on the determination result of the level of transience in the above manner by the transience detecting part. In other words, the transience detecting part determines that the level of transience is decreased with the increasing time period during which the powers of all the frequency bands are not lower than the threshold value in the target frame. The spectrum inverting part converts the time-frequency signal into the MDCT coefficient corresponding to the longer window as the level of transience of the target frame is decreased.

The multi-channel audio signal to be down mixed in the audio decoding apparatus is not limited to the 5.1-ch audio signal and may be a 3.1-ch audio signal or a 7.1-ch audio signal. In addition, the audio signal resulting from the down-mixing process in the audio decoding apparatus is not limited to the stereo audio signal. The audio signal resulting from the down-mixing process may be any audio signal having channels of a number that is smaller than the number of channels of the original audio signal. For example, when the original audio signal is a 5.1-ch audio signal, the audio signal resulting from the down-mixing process may be a 3.1-ch audio signal or a monophonic audio signal. When the original audio signal is a 7.1-ch audio signal, the audio signal resulting from the down-mixing process may be a 5.1-ch audio signal, a 3.1-ch audio signal, a stereo audio signal, or a monophonic audio signal.

It may be sufficient for the processing unit in the audio decoding apparatus to include the dequantizing parts of a number corresponding to the number of channels of the received audio signal, and the transience detecting parts, the spectrum inverting parts, and the audio recomposing parts of a number corresponding to the number of channels of the audio signal to be included.

When the audio signal that is included in the down-mixing process is not reproduced but is stored in the storage unit as electronic data or is transmitted to another apparatus over a communication network, the audio reproducing unit may be omitted in the audio decoding apparatus.

In addition, the transience detecting parts may be omitted in the processing unit in the audio decoding apparatus in the above embodiment, depending on the quality level of a reproduced sound required in the audio decoding apparatus. In the above case, the spectrum inverting part in the processing unit converts the time-frequency signal into the MDCT coefficient corresponding to the window having a predetermined length.

Furthermore, the audio signal to be down mixed in the audio decoding apparatus may be converted into a frequency spectrum by using frequency conversion other than the MDCT, for example, Discrete Cosine Transform. Also in the above case, the audio decoding apparatus can perform the down-mixing process on the received audio signal according to the procedure and process described above.

Furthermore, the functions of an exemplary processing unit may be included in one integrated circuit, one circuit board, or computer programs causing a processor to execute the functions. The integrated circuit, the circuit board, or the computer programs in which the functions of the processing unit are included are included in various devices including a computer, a video-signal recording-reproducing apparatus, and a mobile phone, which are used to edit or reproduce audio signals.

The embodiments can be implemented in computing hardware (computing apparatus) and/or software, such as (in a non-limiting example) any computer that can store, retrieve, process and/or output data and/or communicate with other computers. The results produced can be displayed on a display of the computing hardware. A program/software implementing the embodiments may be recorded on non-transitory computer-readable media comprising computer-readable recording media. Examples of the computer-readable recording media include a magnetic recording apparatus, an optical disk, a magneto-optical disk, and/or a semiconductor memory (for example, RAM, ROM, etc.). Examples of the magnetic recording apparatus include a hard disk device (HDD), a flexible disk (FD), and a magnetic tape (MT). Examples of the optical disk include a DVD (Digital Versatile Disc), a DVD-RAM, a CD-ROM (Compact Disc-Read Only Memory), and a CD-R (Recordable)/RW.

Further, according to an aspect of the embodiments, any combinations of the described features, functions and/or operations can be provided.

The many features and advantages of the embodiments are apparent from the detailed specification and, thus, it is intended by the appended claims to cover all such features and advantages of the embodiments that fall within the true spirit and scope thereof. Further, since numerous modifications and changes will readily occur to those skilled in the art, it is not desired to limit the inventive embodiments to the exact construction and operation illustrated and described, and accordingly all suitable modifications and equivalents may be resorted to, falling within the scope thereof.

What is claimed is:

1. An audio decoding apparatus comprising:

a memory configured to store a plurality of instructions; and a processor configured to execute the instructions, the instructions comprising, a signal acquiring instruction configured to receive a first audio signal that has a first number of channels and that is encoded;

a dequantizing instruction configured to decode and dequantize the encoded first audio signal in each channel to calculate a first frequency spectrum;

a spectrum converting instruction configured to divide the first frequency spectrum in each channel of the first audio signal in a time direction or in a frequency direction to calculate a first signal sequence having the same time resolution and the same frequency resolution in all the channels of the first audio signal;

a down-mixing instruction configured to perform weighted addition on the signals at the same time and within the same frequency band included in the first signal sequence in all the channels to include a second signal sequence having channels of a second number different from the first number of channels;

a spectrum inverting instruction configured to obtain one frequency spectrum value of the same frequency band from the signals within the frequency band included in each of the second signal sequences of a first predetermined number, which are continuous in the time direction, in each channel of the second signal sequence or obtain one frequency spectrum value from the signals within frequency bands of a second predetermined number, which are continuous in the frequency direction, in the second signal sequence to convert the second signal sequence into a second frequency spectrum having the second number of channels; and an audio recomposing instruction configured to convert the second frequency spectrum into a second audio signal in a time domain.

2. The audio decoding apparatus according to claim 1, wherein the second number of channels is smaller than the first number of channels.

3. The audio decoding apparatus according to claim 1, the instructions further comprising:

a transience detecting instruction configured to determine that the second signal sequence included in a frame including the second signal sequences of the first predetermined number has transience if the powers of the respective frequency bands of the second signal sequence are not lower than a predetermined threshold value at any time in the frame, and determine that the second signal sequence included in the frame does not have the transience if the power of any frequency band in the second signal sequence is lower than the predetermined threshold value at all the times in the frame, wherein the spectrum inverting instruction obtains one frequency spectrum value from the signals within the continuous frequency bands of the second number in the second signal sequence to convert the second signal sequence at each time included in the frame into the second frequency spectrum at the time if the second signal sequence included in the frame has the transience, and obtains one frequency spectrum value from the signals within the same frequency band in all the second signal sequences included in the frame to convert the all the second signal sequences included in the frame into the one second frequency spectrum if the second signal sequence included in the frame does not has the transience.

4. The audio decoding apparatus according to claim 3, wherein the transience detecting instruction determines the predetermined threshold value of each frequency band based on a mean value of the powers of the frequency bands corresponding to the respective second signal sequences, calculated for a third predetermined number of frames acquired before the frame.

5. The audio decoding apparatus according to claim 1, the instructions further comprising:

a transience detecting instruction configured to determine that the second signal sequence included in a frame including the second signal sequences of the first predetermined number has transience if the first frequency spectrum in any channel corresponding to the second signal sequence is calculated by time-frequency conversion in a second time length that is longer than a first time length in the frame, and determine that the second signal sequence included in the frame does not have the transience if the first frequency spectra in all the channels corresponding to the second signal sequence is calculated by the time-frequency conversion in the first time length in the frame, wherein the spectrum inverting instruction obtains one frequency spectrum value from the signals within the continuous frequency bands of the second number in the second signal sequence to convert the second signal sequence at each time included in the frame into the second frequency spectrum at the time if the second signal sequence included in the frame has the transience, and obtains one frequency spectrum value from the signals within the same frequency band in all the second signal sequences included in the frame to convert the all the second signal sequences included in the frame into the one second frequency spectrum if the second signal sequence included in the frame does not have the transience.

6. The audio decoding apparatus according to claim 1, wherein the first frequency spectrum includes a long-time frequency spectrum that is calculated by time-frequency conversion of the first audio signal in a first channel in a first time length and a short-time frequency spectrum that is calculated by the time-frequency conversion of the first audio signal in a second channel in a second time length shorter than the first time length, and wherein the spectrum converting instruction divides the long-time frequency spectrum in the time direction so as to have the same time resolution as that of the short-time frequency spectrum and divides the short-time frequency spectrum in the frequency direction so as to have the same frequency resolution as that of the long-time frequency spectrum.

7. The audio decoding apparatus according to claim 1, wherein the spectrum converting instruction divides each Modified Discrete Cosine Transform (MDCT) coefficient included in a set of MDCT coefficients in each channel having a small number of signal values in the frequency direction in a frequency-axis direction so that time-frequency signals in each channel have signal values of a same number as the set of MDCT coefficients having a largest number of signal values in the frequency direction, and divides the MDCT coefficients in each channel in a time-axis direction so that the MDCT coefficients in each channel have a time resolution coinciding with that of the MDCT coefficients calculated by using a window having the smallest length.

8. An audio decoding method comprising:

receiving a first audio signal that has a first number of channels and that is encoded;

decoding and dequantizing the encoded first audio signal in each channel to calculate a first frequency spectrum;

dividing the first frequency spectrum in each channel of the first audio signal in a time direction or in a frequency direction to calculate a first signal sequence having the same time resolution and the same frequency resolution in all the channels of the first audio signal;

performing weighted addition on the signals at the same time and within the same frequency band included in the first signal sequence in all the channels to include a second signal sequence having channels of a second number different from the first number of channels;

obtaining one frequency spectrum value of the same frequency band from the signals within the frequency band included in each of the second signal sequences of a first predetermined number, which are continuous in the time direction, in each channel of the second signal sequence or obtaining one frequency spectrum value from the signals within frequency bands of a second predetermined number, which are continuous in the frequency direction, in the second signal sequence to convert the second signal sequence into a second frequency spectrum having the second number of channels; and converting the second frequency spectrum into a second audio signal in a time domain.

9. An audio decoding circuit comprising:

a dequantizing circuit configured to decode and dequantize a first audio signal in each channel to calculate a first frequency spectrum, the first audio signal having a first number of channels and being encoded;

a spectrum converting circuit configured to divide the first frequency spectrum in each channel of the first audio signal in a time direction or in a frequency direction to calculate a first signal sequence having the same time resolution and the same frequency resolution in all the channels of the first audio signal;

a down-mixing circuit configured to perform weighted addition on the signals at the same time and within the same frequency band included in the first signal sequence in all the channels to include a second signal sequence having channels of a second number different from the first number of channels;

a spectrum inverting circuit configured to obtain one frequency spectrum value of the same frequency band from the signals within the frequency band included in each of the second signal sequences of a first predetermined number, which are continuous in the time direction, in each channel of the second signal sequence or obtain one frequency spectrum value from the signals within frequency bands of a second predetermined number, which are continuous in the frequency direction, in the second signal sequence to convert the second signal sequence into a second frequency spectrum having the second number of channels; and an audio recomposing circuit configured to convert the second frequency spectrum into a second audio signal in a time domain.

10. A non-transitory computer-readable storage medium including a program to cause an audio decoding apparatus to execute operations, the program comprising:

decoding and dequantizing a first audio signal in each channel to calculate a first frequency spectrum, the first audio signal having a first number of channels and being encoded;

dividing the first frequency spectrum in each channel of the first audio signal in a time direction or in a frequency direction to calculate a first signal sequence having the same time resolution and the same frequency resolution in all the channels of the first audio signal;

performing weighted addition on the signals at the same time and within the same frequency band included in the first signal sequence in all the channels to include a second signal sequence having channels of a second number different from the first number of channels;

obtaining one frequency spectrum value of the same frequency band from the signals within the frequency band included in each of the second signal sequences of a first predetermined number, which are continuous in the time direction, in each channel of the second signal sequence or obtaining one frequency spectrum value from the signals within frequency bands of a second predetermined number, which are continuous in the frequency direction, in the second signal sequence to convert the second signal sequence into a second frequency spectrum having the second number of channels; and converting the second frequency spectrum into a second audio signal in a time domain.

11. A decoding method comprising:

receiving a first encoded signal that has a first number of channels;

decoding with a microprocessor the received signal in each channel to calculate a first frequency spectrum;

calculating a first signal sequence having a same time resolution and frequency resolution in all the channels;

performing weighted addition on the signals in the first signal sequence to calculate a second signal sequence;

converting the second signal sequence into a second frequency spectrum having a second number of channels; and converting the second frequency spectrum into a second signal in a time domain.

* * * * *